US011267103B2

(12) United States Patent
Baker et al.

(10) Patent No.: US 11,267,103 B2
(45) Date of Patent: Mar. 8, 2022

(54) FOLDABLE TOOL SHARPENER

(71) Applicant: Darex, LLC, Ashland, OR (US)

(72) Inventors: Steven Lee Baker, Medford, OR (US); Joseph Todd Zachariasen, Medford, OR (US)

(73) Assignee: DAREX, LLC

( * ) Notice: Subject to any disclaimer, the term of this patent is extended or adjusted under 35 U.S.C. 154(b) by 0 days.

(21) Appl. No.: 16/887,857

(22) Filed: May 29, 2020

(65) Prior Publication Data

US 2020/0376629 A1 Dec. 3, 2020

Related U.S. Application Data

(60) Provisional application No. 62/854,068, filed on May 29, 2019.

(51) Int. Cl.
*B24D 15/08* (2006.01)

(52) U.S. Cl.
CPC ..... *B24D 15/082* (2013.01); *B24D 15/088* (2013.01)

(58) Field of Classification Search
CPC .... B24B 3/36; B24B 3/52; B24B 3/54; B24B 3/605; B24D 15/02; B24D 15/063; B24D 15/065; B24D 15/08; B24D 15/081; B24D 15/082; B24D 15/084; B26B 1/044; B26B 1/046; B26B 1/02; B26B 1/04; B26B 11/003; B25F 1/04
USPC ..... 76/82, 82.2, 84, 86; 7/118, 120; 30/138; 451/552
See application file for complete search history.

(56) References Cited

U.S. PATENT DOCUMENTS

| | | | | |
|---|---|---|---|---|
| 386,544 | A * | 7/1888 | Johnson et al. | B24D 15/08 451/555 |
| 1,131,374 | A * | 3/1915 | Haywood | B24D 15/081 76/86 |
| 1,282,705 | A * | 10/1918 | Morche | B24D 15/081 76/86 |
| 1,946,350 | A | 2/1934 | Boulanger et al. | |
| 3,942,394 | A * | 3/1976 | Juranitch | B24D 15/06 76/84 |
| 4,259,815 | A | 4/1981 | Kuban | |
| 4,640,058 | A | 2/1987 | Glesser | |
| 5,046,385 | A | 9/1991 | Cozzini et al. | |
| 6,626,066 | B2 | 9/2003 | Koppe | |
| 6,769,331 | B2 | 8/2004 | Berg et al. | |

(Continued)

FOREIGN PATENT DOCUMENTS

AU 2010202744 A1 1/2011

*Primary Examiner* — Joel D Crandall
(74) *Attorney, Agent, or Firm* — Hall Estill Law Firm

(57) ABSTRACT

Apparatus and method for sharpening a cutting tool, such as a knife. A sharpener includes a first support member, a second support member and a hinge assembly. The first support member supports a first abrasive surface and has at least a first guide at a selected end of the first abrasive surface. The second support member supports a second abrasive surface and has at least a second guide at a selected end of the second abrasive surface. A hinge assembly couples the first and second support member to facilitate movement of the second support member relative to the first support member between a closed position and an open position. In the closed position, the first guide is in facing relation to the second guide and the first abrasive surface is in facing relation to the second abrasive surface.

23 Claims, 8 Drawing Sheets

(56) References Cited

U.S. PATENT DOCUMENTS

| | | | | |
|---|---|---|---|---|
| 7,467,991 | B2 | 12/2008 | McCowen et al. | |
| 7,553,220 | B2 | 6/2009 | Smith | |
| 8,790,162 | B1 * | 7/2014 | Dovel | B24B 3/54 451/45 |
| 8,951,098 | B2 | 2/2015 | Jhones | |
| 9,039,494 | B1 | 5/2015 | Dovel | |
| D731,278 | S | 6/2015 | Cavanaugh | |
| 9,623,533 | B2 | 4/2017 | Dovel | |
| 9,833,879 | B1 | 12/2017 | Dovel | |
| 10,328,561 | B1 | 6/2019 | Weinberger et al. | |
| D854,392 | S | 7/2019 | Watson et al. | |
| 2003/0121368 | A1 | 7/2003 | Koppe | |
| 2014/0154963 | A1 | 6/2014 | Jhones | |
| 2015/0079880 | A1 | 3/2015 | Dovel | |
| 2016/0354909 | A1 * | 12/2016 | Weinberger | B26B 11/00 |
| 2018/0015586 | A1 | 1/2018 | Hammond et al. | |

* cited by examiner

FOLDABLE TOOL SHARPENER

RELATED APPLICATIONS

The present application makes a claim of domestic priority to U.S. Provisional Patent Application No. 62/854,068 filed May 29, 2019, the contents of which are hereby incorporated by reference.

BACKGROUND

Cutting tools are used in a variety of applications to cut or otherwise remove material from a workpiece. A variety of cutting tools are well known in the art, including but not limited to knives, scissors, shears, blades, chisels, machetes, saws, drill bits, etc.

A cutting tool often has one or more laterally extending, straight or curvilinear cutting edges along which pressure is applied to make a cut. The cutting edge is often defined along the intersection of opposing surfaces (bevels) that intersect along a line that lies along the cutting edge.

In some cutting tools, such as many types of conventional kitchen knives, the opposing surfaces are generally symmetric; other cutting tools, such as many types of scissors and chisels, have a first opposing surface that extends in a substantially normal direction, and a second opposing surface that is skewed with respect to the first surface.

Complex blade geometries can be used, such as multiple sets of bevels at different respective angles that taper to the cutting edge. Scallops or other discontinuous features can also be provided along the cutting edge, such as in the case of serrated knives.

Cutting tools can become dull over time after extended use, and thus it can be desirable to subject a dulled cutting tool to a sharpening operation to restore the cutting edge to a greater level of sharpness. A variety of sharpening techniques are known in the art, including the use of grinding wheels, whet stones, abrasive cloths, abrasive belts, etc.

SUMMARY

Various embodiments of the present disclosure are generally directed to an apparatus and method for sharpening a cutting tool, such as a knife.

In some embodiments, a sharpener includes a first support member, a second support member and a hinge assembly. The first support member supports a first abrasive surface and has at least a first guide at a selected end of the first abrasive surface. The second support member supports a second abrasive surface and has at least a second guide at a selected end of the second abrasive surface. A hinge assembly couples the first and second support member to facilitate movement of the second support member relative to the first support member between a closed position and an open position. In the closed position, the first guide is in facing relation to the second guide and the first abrasive surface is in facing relation to the second abrasive surface.

In related embodiments, a method is provided for sharpening a cutting tool having a blade portion with a cutting edge. The method includes transitioning a foldable sharpener from a closed position to an open position by rotating a second support member relative to a first support member via an intervening hinge assembly; performing a primary sharpening operation upon the cutting tool by grasping the second support member in a first hand of a user, grasping the cutting tool in a second hand of the user, and advancing the cutting edge along a first abrasive surface of the first support member; and performing a secondary sharpening operation upon the cutting tool by subsequently grasping the first support member in the first hand, grasping the cutting tool in the second hand, and advancing the cutting edge along a second abrasive surface of the second support member, wherein in the closed position the first abrasive surface is in facing relation to the second abrasive surface and a first guide surface of the first support member is in facing relation to a second guide surface of the second support member.

These and other features and advantages of various embodiments can be understood from a review of the following detailed description in conjunction with the accompanying drawings.

DETAILED DESCRIPTION

Figure 1A:
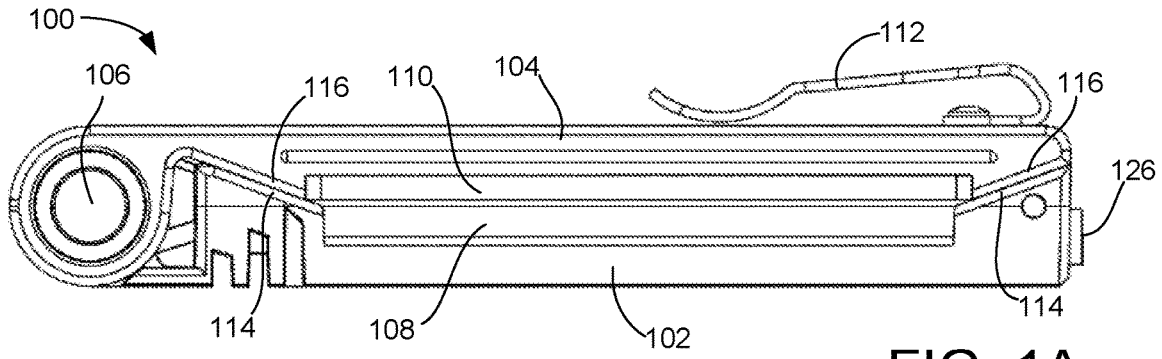
FIGS. 1A through 1D show respective side, top and bottom views of a foldable tool sharpener constructed and operated in accordance with various embodiments of the present disclosure.

Various embodiments of the present disclosure are generally directed to a foldable tool sharpener adapted to sharpen the cutting edge of a cutting tool, such as but not limited to a pocket knife, and a method for using the same.

As explained below, various embodiments provide the sharpener with first and second support members which respectively support first and second abrasive members. The abrasive members can take a variety of forms, but in some embodiments the first abrasive member is a ceramic cylindrical rod and the second abrasive member is a leather strop. Each of the abrasive members has an abrasive surface adapted to carry out a sharpening/honing operation upon the cutting edge of the tool. The first and second support members are hingedly coupled one to another using an intervening hinge assembly to allow relative rotation of the first support member with respect to the second support member.

In a closed position, the first and second abrasive members are in facing relation to each other. In an open position, the second support member is rotated away from the first support member over an overall rotational range that exceeds 180 degrees. In some embodiments, the second support member rotates a total angular amount of approximately 220 degrees so that the first and second support members are arranged at an interior angle of approximately 140 degrees apart. In other embodiments, the total interior angle between the first and second support members can be from about 110 degrees to about 160 degrees. Other ranges can be used, however, including but not limited to up to a total rotational range of approximately 360 degrees so that the sharpener can be folded back upon itself.

This overall range of rotation can allow each the respective support members to serve as an ergonomically placed handle that can be comfortably grasped by a first hand of a user while a sharpening operation is carried out upon the abrasive member of the other support member using a second hand of the user. For example, the first hand of the user can grasp the first support member so that the fingers are wrapped around and the first support member is held firmly against the palm of the first hand and the thumb of the first hand rests against the hinge assembly. The second hand of the user grasps a handle of the cutting tool and controllably advances a blade portion of the cutting tool across the abrasive surface of the abrasive member of the second support member.

In at least some embodiments, the first support member has a pair of opposing forward guides at each end of the first abrasive member. The forward guides are at a selected angle relative to a top surface of the first abrasive member and are configured to enable the user to orient the side of a blade of the cutting tool prior to advancement of the blade across the first abrasive member in a leading cutting edge orientation during a first sharpening operation.

The second support member has a pair of reverse guides at each end of the second abrasive member. The reverse guides are also arranged at the selected angle relative to a top surface of the second abrasive member to enable the user to orient the side of the blade of the cutting tool prior to advancement of the blade across the second abrasive member in a trailing cutting edge orientation during a second sharpening operation. Because the forward and trailing guides are at nominally the same selected angle in at least some embodiments, the respective forward and trailing guides are complimentary and contactingly mate in parallel facing relation when the sharpener is folded into the closed orientation.

In further embodiments, at least the first abrasive member comprises a cylindrical rod of a suitable material such as ceramic. A keyed alignment member is affixed to a selected end of the rod with a slot extending therethrough. The slot is sized and arranged such that a back (spine) of a blade being sharpened can be inserted into the slot and the blade can be rotated to rotationally advance the rod to a selected angular orientation. This can be used to present new abrasive media after an existing portion of the rod has been used. This can also be used to present different abrasive features of the rod for different sharpening needs.

Figure 1B:
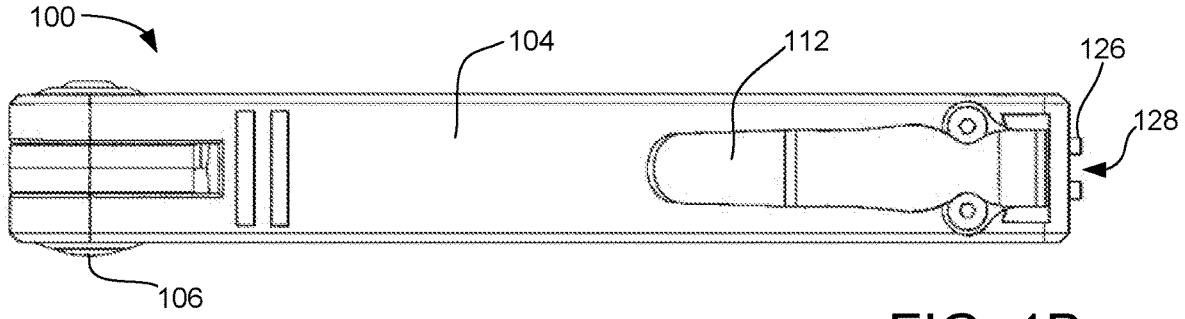
Figure 1C:
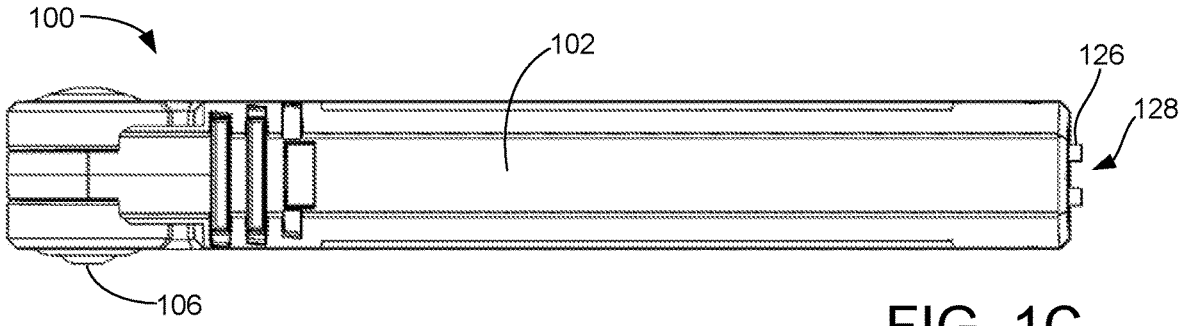
Figure 1D:
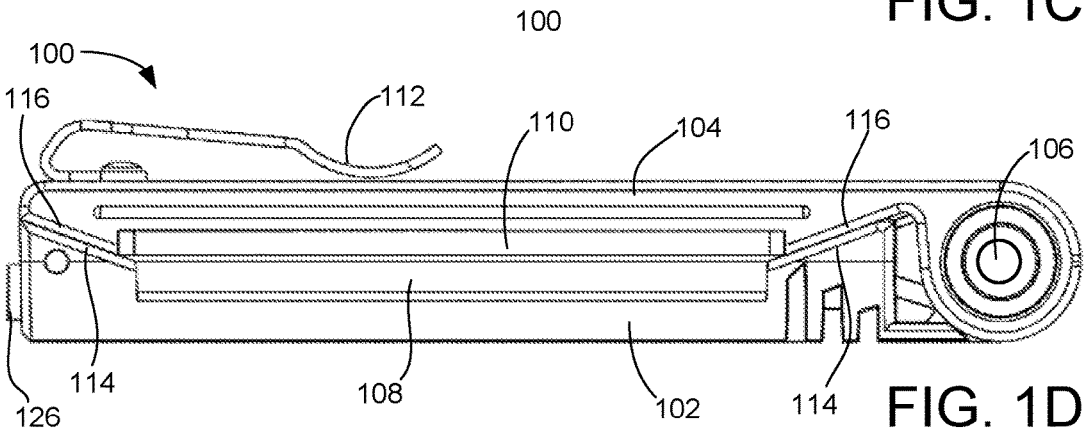

These and other features and advantages of various embodiments can be understood with a review of FIGS. 1A through 1D which show respective views of a foldable tool sharpener 100. FIG. 1A is a right-side elevational view; FIG. 1B is a top plan view; FIG. 1C is a bottom plan view; and FIG. 1D is a left-side elevational view. The sharpener 100 is in a normally closed position in each of these views.

The sharpener 100 includes a first support member 102 and a second support member 104 coupled together using a hinge assembly 106. The first support member 102 supports a first abrasive member 108, which in some embodiments takes the form of a cylindrical abrasive ceramic rod. The second support member 104 supports a second abrasive member 110, which in some embodiments takes the form of a planar leather strop. Other forms of abrasive members can be used as desired. A spring clip 112 is affixed to an outside surface of the second support member 104 to enable the sharpener 100 to be affixed inside a pocket or other location when not in use.

Figure 2A:
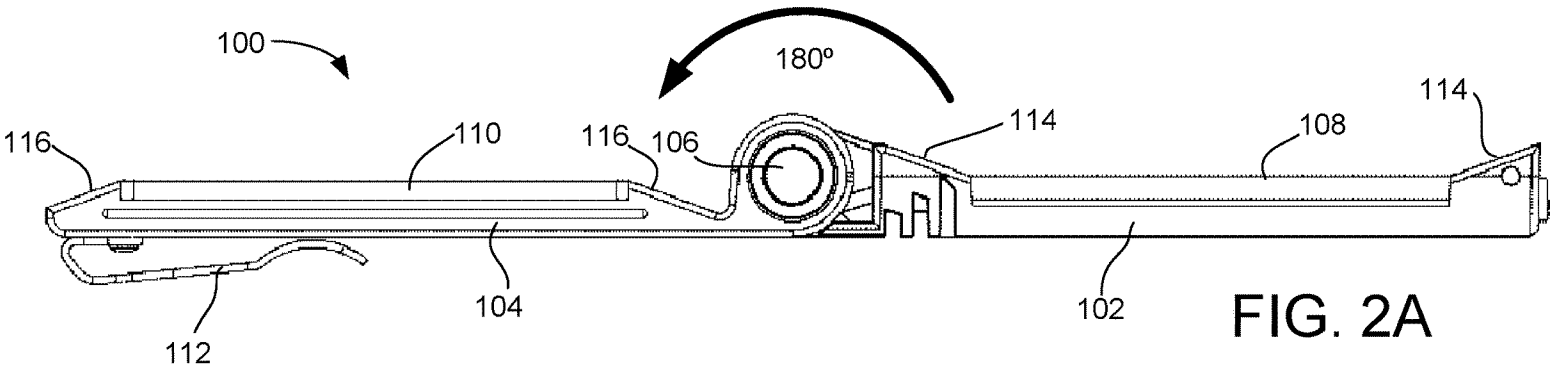
FIGS. 2A and 2B show side elevational views of the sharpener in different deployed states.
Figure 2B:
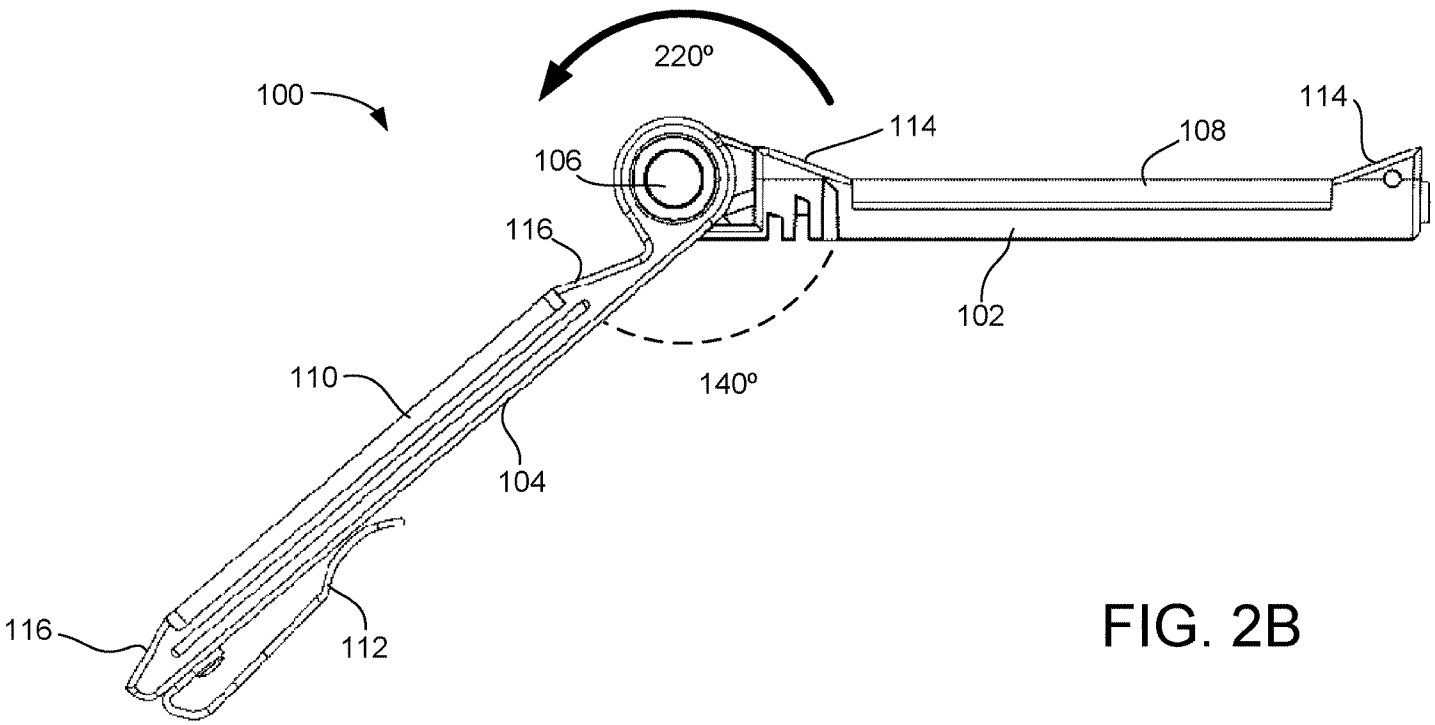

The first and second support members 102, 104 are rotatable about the hinge assembly 106 over an overall angular range. FIG. 2A shows the members 102, 104 to have been rotated approximately 180 degrees from the closed position, allowing the sharpener 100 to be placed on a nominally flat surface during use. FIG. 2B shows the members 102, 104 to have been rotated over a maximum range of approximately 220 degrees from the closed position, so that an interior angle of approximately 140 degrees extends between the members. The orientation in FIG. 2B provides the members at an ergonomic angle such that one of the members, such as member 104, can be grasped by a first hand of a user while a second hand of the user grasps the handle of a cutting tool (such as a pocket knife) for a sharpening operation upon the remaining member, such as member 102.

Figure 3A:
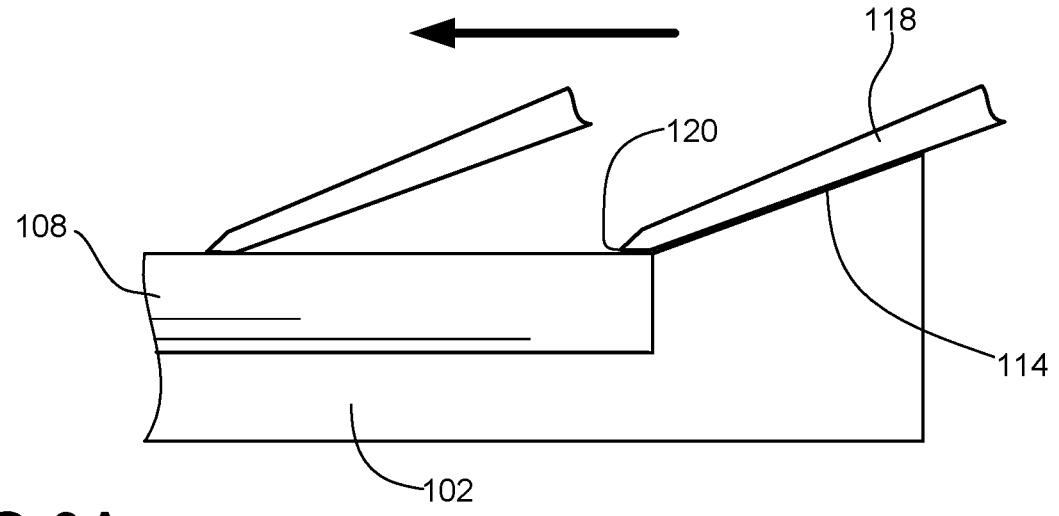
FIGS. 3A and 3B show schematic depictions of guide features of the sharpener in some embodiments.

The first member 102 includes a pair of opposing forward guides 114 at each end of the first abrasive member 108. The second member 104 includes a pair of opposing reverse guides 116 at each end of the first abrasive member 110. As shown in FIG. 3A, the forward guides 114 enable a user to carry out a leading cutting edge sharpening operation in which a blade 118 is placed against the forward guide 114, after which the user maintains the selected angle and advances the blade forward with a cutting edge 120 of the blade 118 in a leading orientation as shown.

Figure 3B:
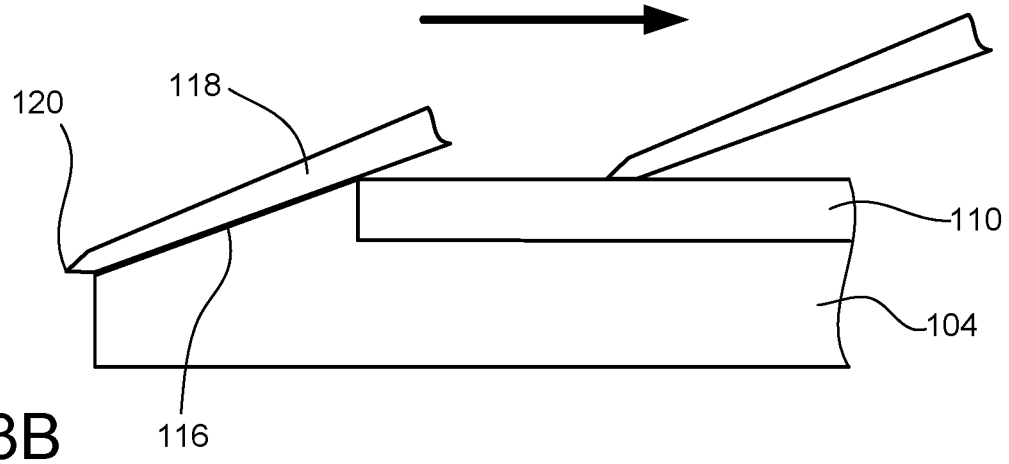

FIG. 3B shows the use of the reverse guides 116 to enable a user to carry out a trailing cutting edge sharpening operation in which the blade is placed against the reverse guide 116, after which the user maintains the selected angle and advances the blade forward with the cutting edge in a trailing orientation as shown. The trailing orientation of FIG. 3B enables the leather strop 110 to provide a fine honing operation upon the blade 118 without causing the cutting edge to cut into or otherwise damage the leather strop material.

Figure 4:
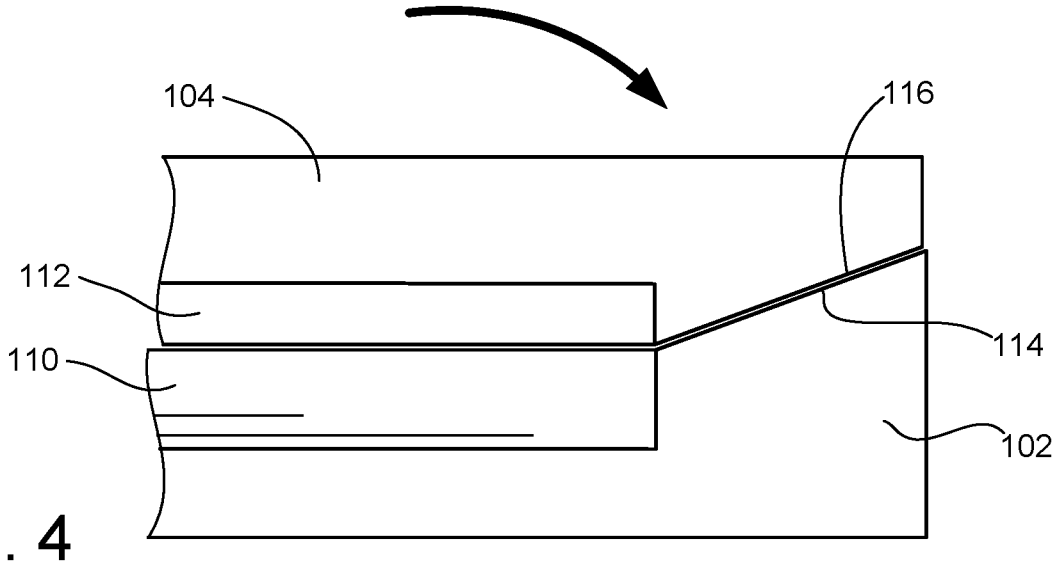
FIG. 4 shows the relative orientation of the guide features of FIGS. 3A and 3B with the sharpener in a closed position.

FIG. 4 shows the alignment of the respective guides 114, 116 in parallel facing relation to one another when the sharpener 100 is in the closed position. Because both of the guides are contemplated as extending at the same selected angle (such as e.g., 25 degrees, etc.), the rotation of the second member 104 about the hinge assembly 106 to the closed position makes the two guides 114, 116 extend at complementary angles as shown. It is contemplated albeit not necessarily required that the guides 114, 116 will contactingly engage each other in the closed position.

While using guides 114, 116 having the same selected angle has been illustrated, such is not necessarily required; in other embodiments, the forward guide 114 may have a first angle such as about 20 degrees and the reverse guide 116 may have a different second angle such as about 25 degrees. The guides can nonetheless be arranged to extend in facing relation as before, although in such case the surfaces will not tend to be parallel as illustrated in FIG. 4.

Figure 5A:
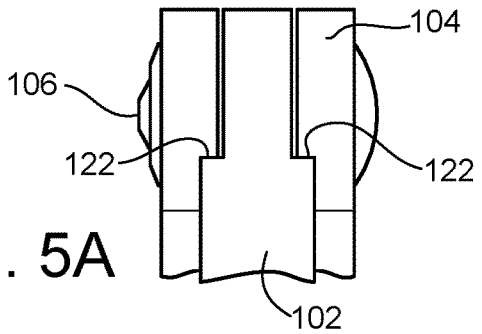
FIGS. 5A through 5D show different top views of aspects of the sharpener at different opening angles in some embodiments.
Figure 5B:
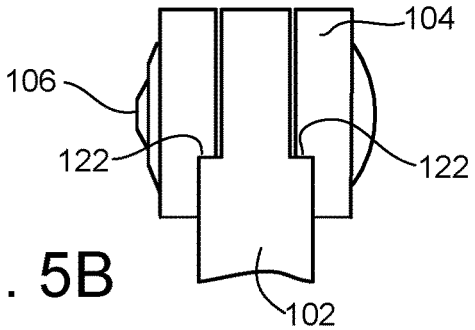
Figure 5C:
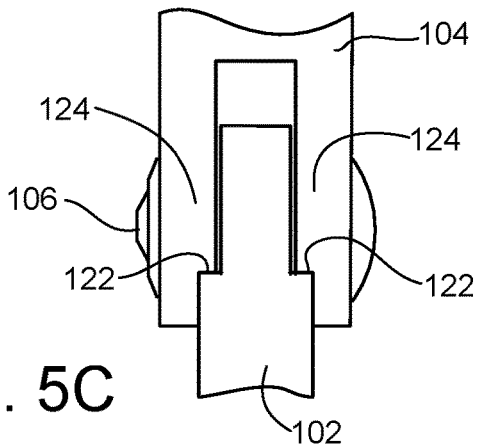
Figure 5D:
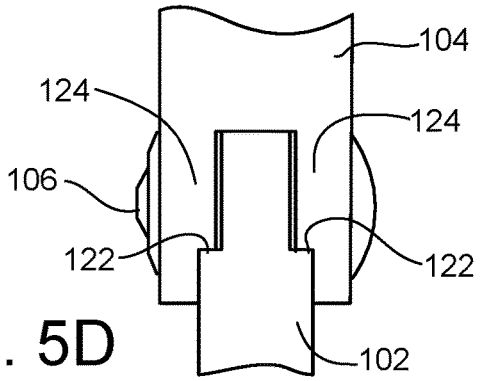
Figure 6A:
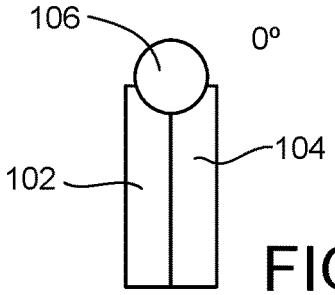
FIGS. 6A through 6D are schematic simplified representations of the sharpener in the different opening angles of FIGS. 5A through 5D
Figure 6B:
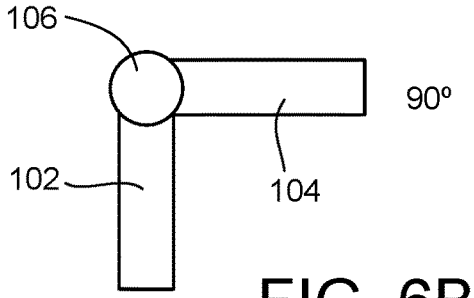
Figure 6C:
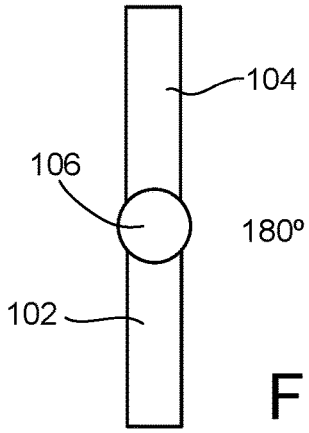
Figure 6D:
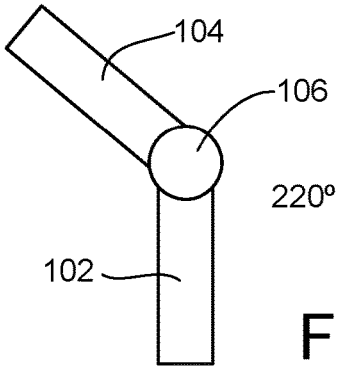

FIGS. 5A through 5D illustrate operation of the hinge assembly 106 in greater detail. As depicted by FIGS. 6A through 6D, each of the orientations of FIGS. 5A through 5D show successive angular advancement of the second member 104 relative to the first member 102. More particularly, FIG. 5A shows the sharpener 100 in the closed position; FIG. 5B shows an angle of 90 degrees; FIG. 5C shows an angle of 180 degrees, as in FIG. 2A; and FIG. 5D shows an angle of 220 degrees, as in FIG. 2B. Shoulder surfaces 122 extend from the first member 102 that come into contact with limit surfaces 124 to limit the maximum opening angle at about 220 degrees.

Figure 7:
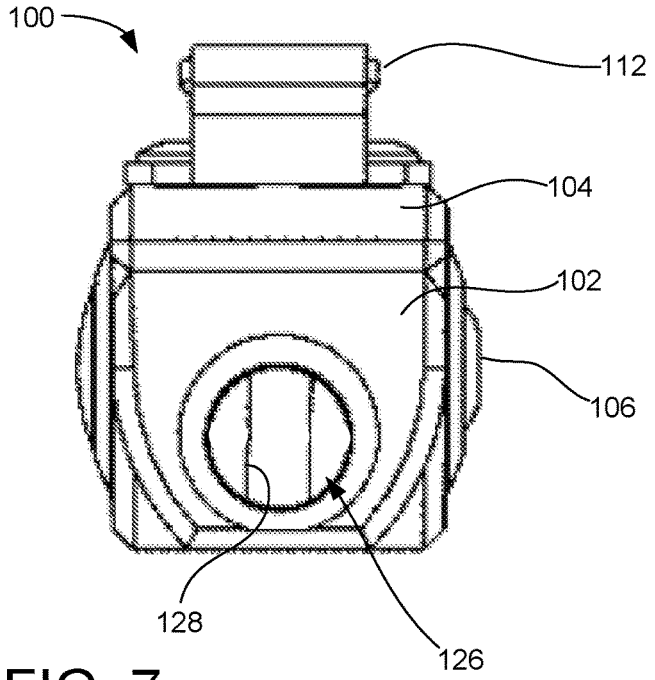
FIG. 7 is an end view of the sharpener to illustrate a keyed alignment member used in some embodiments.
Figure 8:
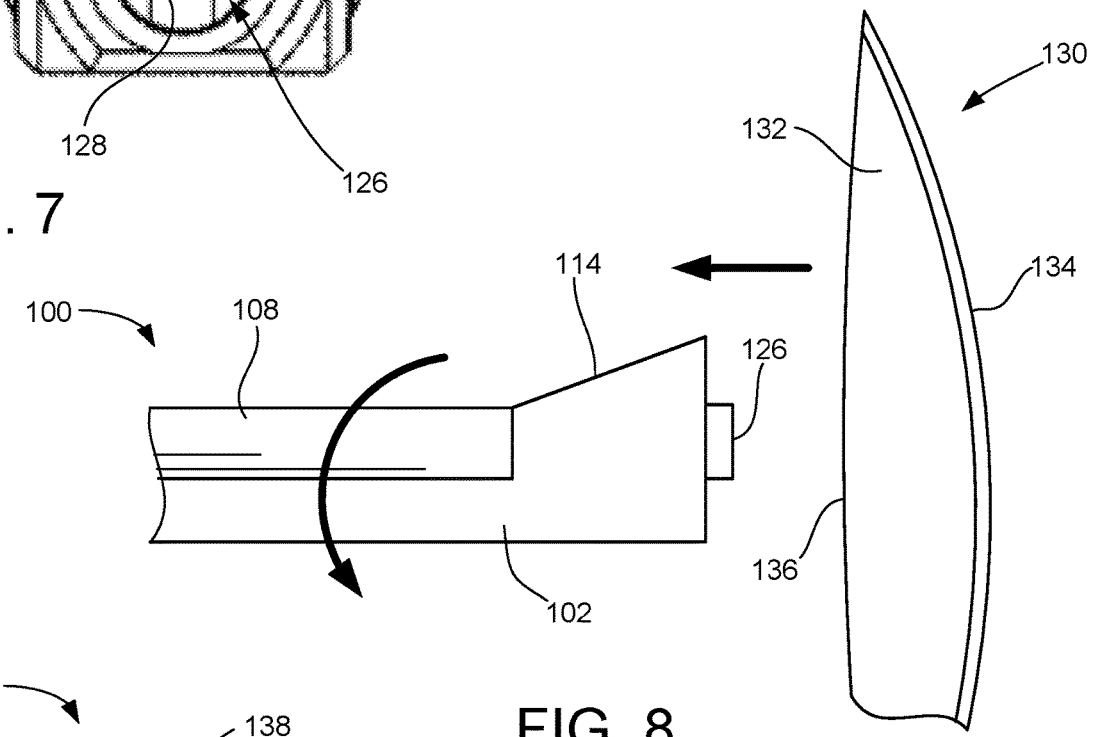
FIG. 8 is a schematic representation of an operation to rotate one of the abrasive elements of the sharpener using a spine of a cutting tool blade in some embodiments.

FIG. 7 shows an end view of the sharpener 100 in further embodiments. A keyed alignment member 126 is affixed to the first abrasive member (e.g., ceramic rod) 108 and projects from one end of the first support member 102 as shown. The alignment member 126 includes a central slot 128. The slot 128 is adapted to receive a driver member to rotate the ceramic rod to a desired angular position. For example, FIG. 8 shows the sharpener 100 in conjunction with a knife 130 with blade 132, cutting edge 134 and spine 136. The spine 136 can be inserted into the slot 128 of the alignment member, allowing the user to easily rotate the ceramic rod as desired.

Figure 9:
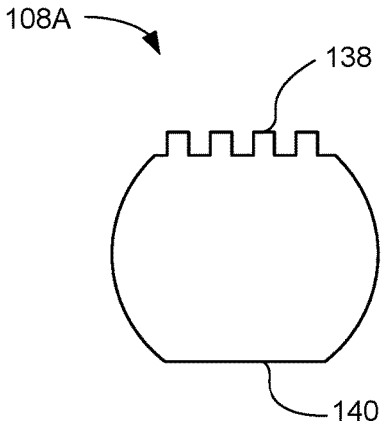
FIG. 9 shows an alternative construction for an abrasive element of the sharpener in further embodiments.

The rotation of the ceramic rod (or other abrasive member) can be used to advance the rod to present a less used section of media, or can be used to bring into view different sharpening features of the abrasive member. FIG. 9 shows an exemplary abrasive member 108A similar to the ceramic rod 108 discussed above. The abrasive member 108A has asymmetric features such as a series of ribs 138 and a flat surface 140 that may be selected by the user for different sharpening needs.

Figure 10:
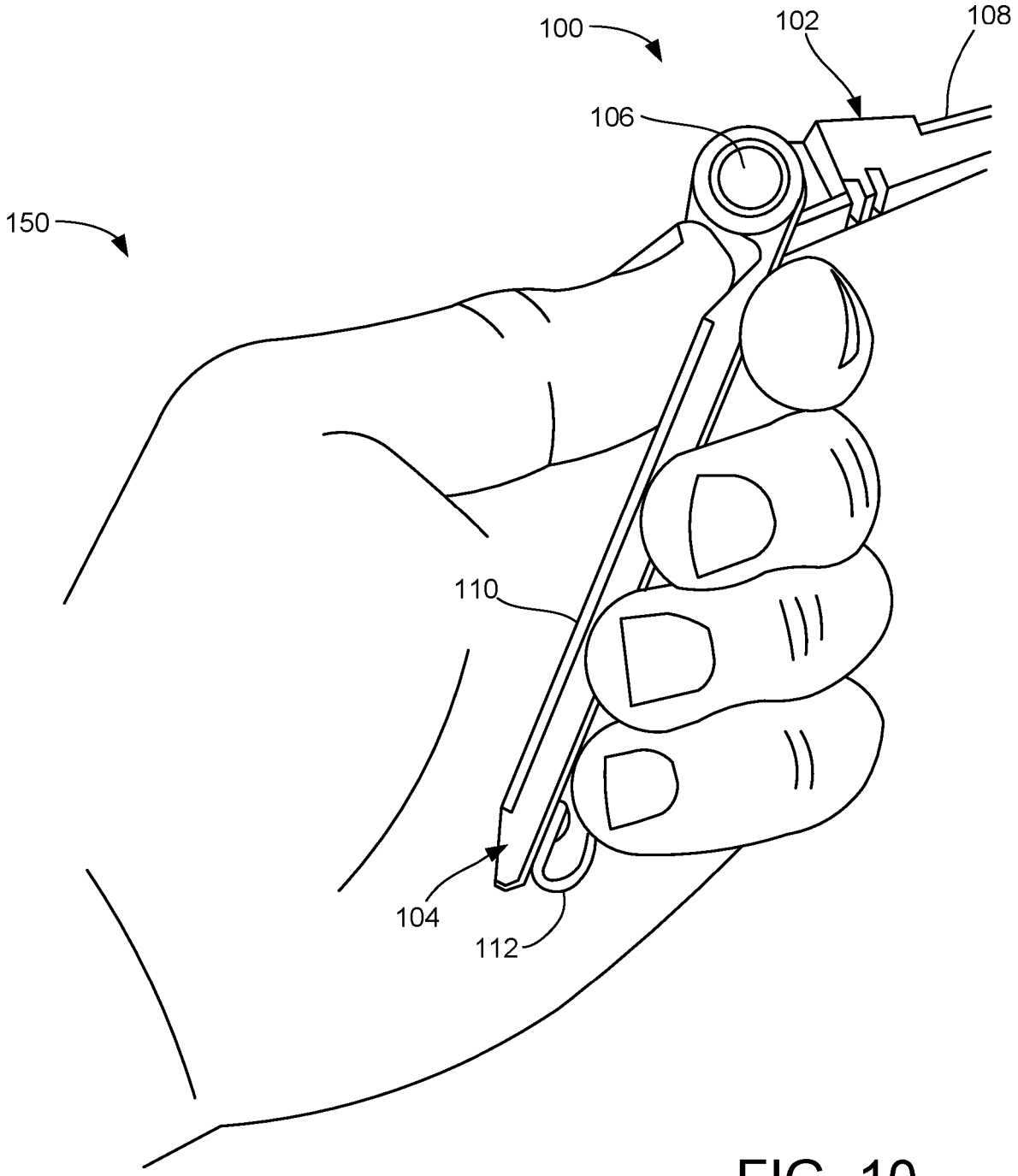
FIG. 10 shows a hand of a user grasping the sharpener during a sharpening operation.

FIG. 10 shows a selected hand 150 of a user grasping the second support member 104 during a sharpening operation using the ceramic rod 108 of the first support member 102. It can be seen that the second member 104 fits comfortably in the palm of the user's hand, and the user's thumb can press against the hinge assembly 106 to stabilize the sharpener 100. The hinge assembly 106 provides a convenient guard against inadvertent contact between the blade and the user's hand. The user can grasp the first support member 102 in a similar fashion to carry out a follow up honing operation upon the blade using the leather strop 110 of the second support member 104.

The embodiments of FIGS. 1-10 generally provide the use of respective forward guides 114 and reverse guides 116, with the forward guides extending upwardly from the associated abrasive surface (e.g., abrasive 108) and the reverse guides extending downwardly from the associated abrasive surface (e.g., abrasive 110). In other embodiments, both sides of the sharpener can use the same type of guides, such as both forward guides or both reverse guides.

Figure 11A:
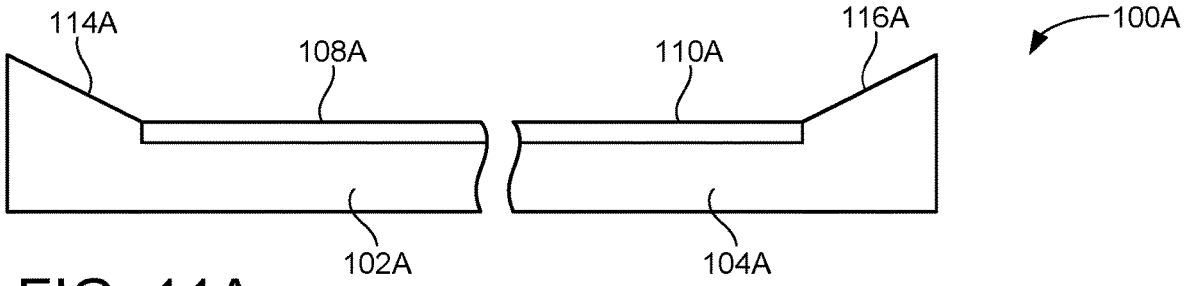
FIGS. 11A and 11B show another sharpener in accordance with further embodiments.
Figure 11B:
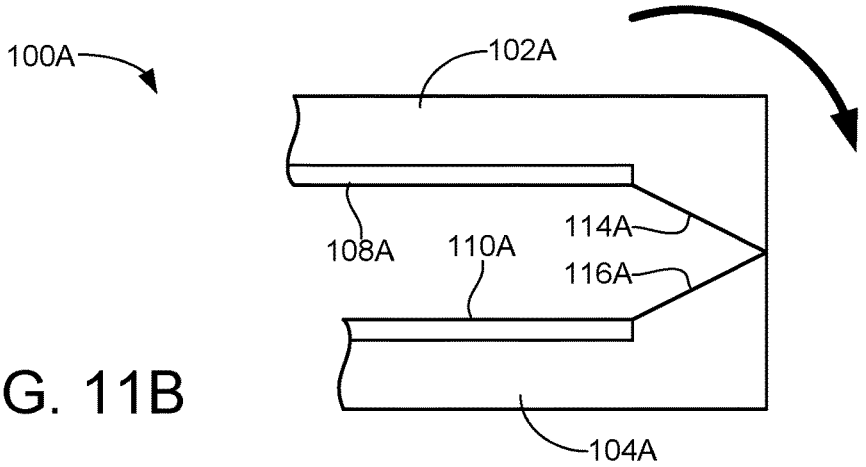

By way of illustration, FIGS. 11A and 11B show an alternative sharpener 100A with support members (sides) 102A and 104A mounted by an intermediary hinge element (not shown) that may generally correspond to the hinge 106 discussed above. The side 102A supports a first abrasive member 108A and the side 104A supports a second abrasive member 110A. Respective forward guides 114A and 116A are provided at each end of the respective abrasive members. As before, the forward guides 114A, 116A may be at the same angle or may extend at different angles.

In this case, the distance between the guides and the abrasives can be set such that the respective tops of the guides are brought into close proximity (including contact) when the sharpener is in the closed position, as generally depicted in FIG. 11B. As before, a suitable overall opening range can be provided, including the range shown in FIG. 10 to facilitate ergonomic handling during use.

Figure 12A:
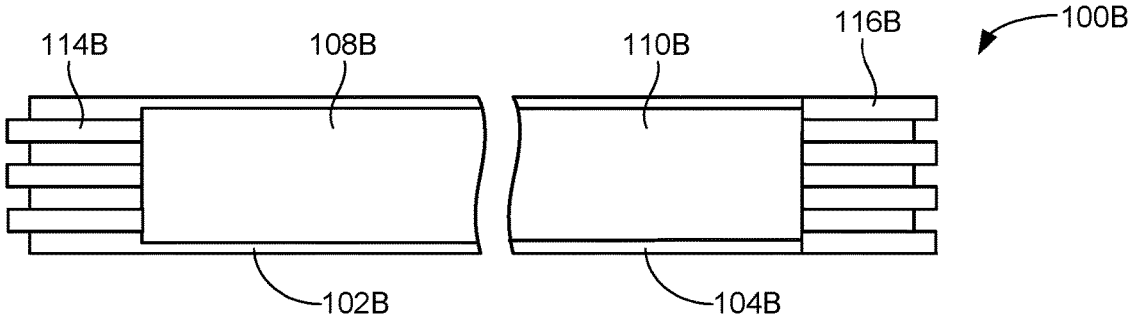
FIGS. 12A and 12B show yet another sharpener in accordance with further embodiments.
Figure 12B:
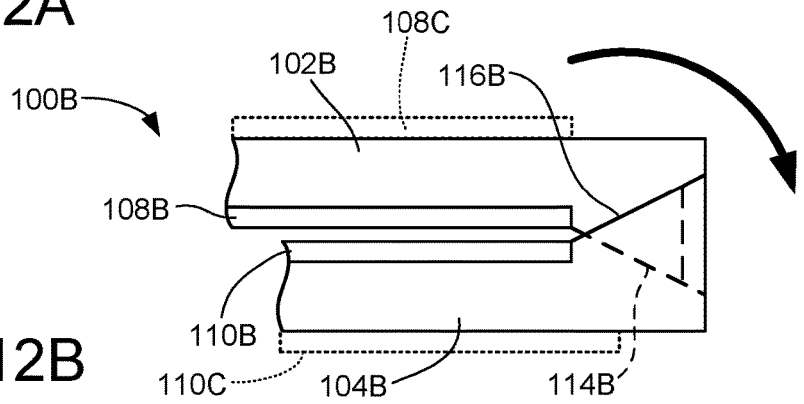

FIGS. 12A and 12B show another alternative sharpener 100B with sides 102B, 104B, abrasive members 108B, 110B, and forward guides 114B, 116B. In this case, the guides 114A, 116B are formed of spaced apart, offset fingers that interlock when the sharpener is closed, as generally depicted in FIG. 12B, allowing the sharpener 100B to have a compact folded arrangement as generally depicted in FIGS. 1A-1D. As desired, optional additional abrasive members 108C, 110C can be affixed to outer surfaces of the respective support members 102B, 104B. Exterior guide surfaces (not separately shown) can additionally be applied to these outer surfaces.

Any number shapes for the abrasive members can be used including but not limited to round, cylindrical, triangular, frusto-conical, grooved, rotatable, and/or flat abrasive members. Any number of types of abrasive members can be used including but not limited to constructions formed of ceramic, metal, leather, stone, sandpaper, abrasive blocks, diamond or other abrasive coatings, etc.

Additional abrasive surfaces can be provided on the outer surfaces of the respective foldable members apart from the interior facing surfaces described herein. While the various embodiments have contemplated the interior abrasive surfaces (e.g., 108, 110, etc.) to be nominally parallel when the sharpener is in the closed position, such is not necessarily required.

Any number of different ranges of opening can be provided such as but not limited to from 0 degrees to 220 degrees; 0 degrees to 60 degrees; 0 degrees to 90 degrees; 0 degrees to 180 degrees; 0 degrees to 270 degrees; 0 degrees to 300 degrees; and 0 degrees to 360 degrees. These and other angles can be within some reasonable tolerance such as +/−10 degrees.

Figure 13:
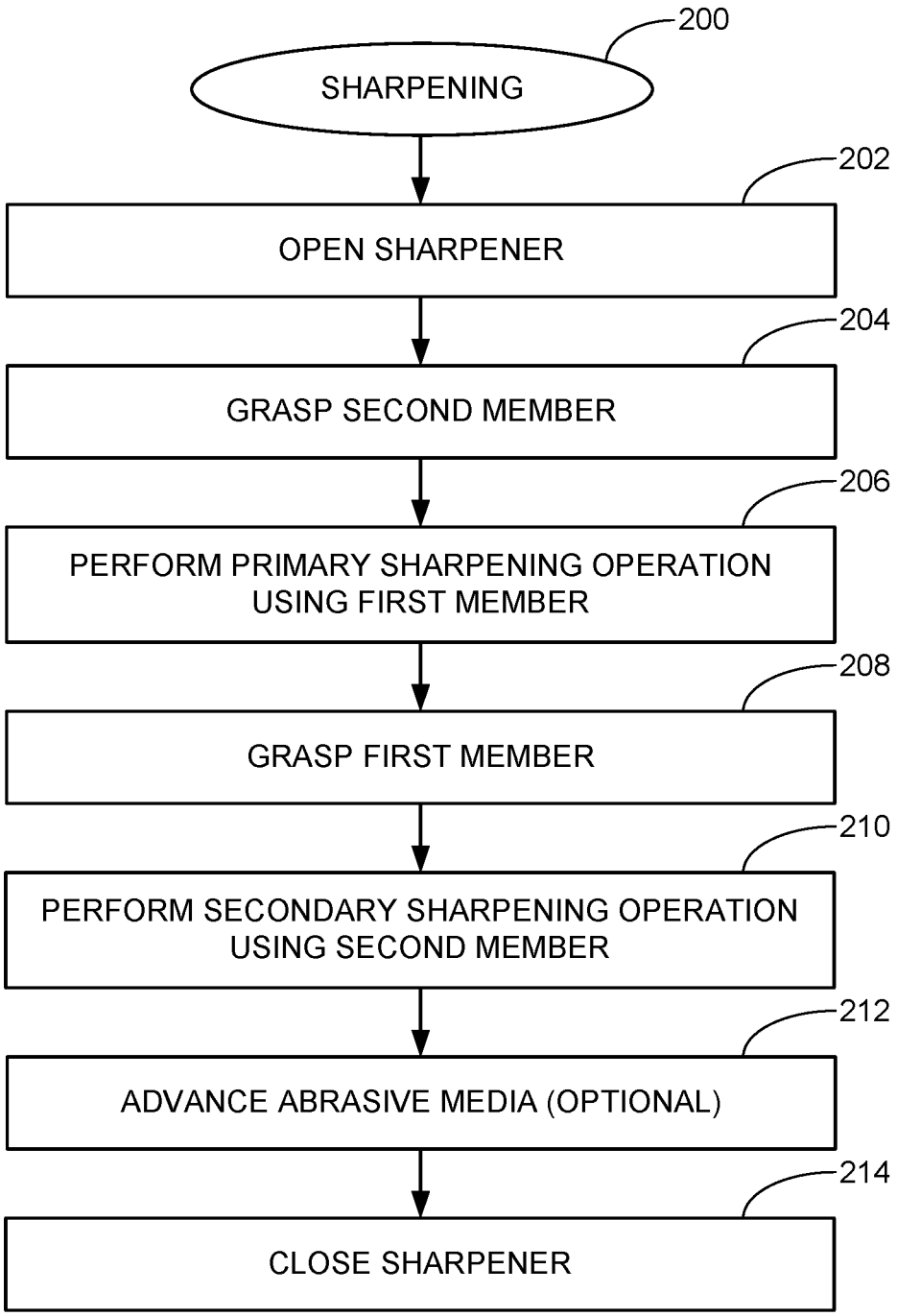
FIG. 13 is a flow chart for a sharpening routine to illustrate steps carried out in accordance with some embodiments.

A method of sharpening a cutting tool such as the tools 118, 130 can be carried out in accordance with a sharpening routine 200 provided in FIG. 13. The routine commences at step 202 in which a user unfolds a sharpener such as 100, 100A, 100B to transition the sharpener from a closed position to an open position. As noted above, the sharpener can be configured to open to any suitable angle. In some cases, the fully open position can be a maximum amount permitted by the hinge to add stability to the sharpener. This can include an interior angle between first and second members (such as 102, 104) of from about 110 degrees to about 160 degrees, to provide an ergonomic sharpening configuration such as illustrated in FIG. 10. While not separately shown in the drawings, a locking feature can be incorporated into the hinge assembly to maintain the respective first and second members at the desired interior angle.

At step 204, the user grasps the second member (e.g. member 104) in a first hand of the user, such as the left hand. This enables the user to grasp a handle portion (not separately shown) of the cutting tool in the remaining second hand of the user, such as the right hand, to carry out a primary sharpening operation upon the first member, step 206. As discussed above, the primary sharpening operation, also referred to as a coarse or first sharpening operation, may include using a guide surface (such as 114) to orient the side of the blade and then advance the blade along the associated abrasive surface (such as 108) a suitable number of times (e.g., 3-5 times, etc).

In some cases, the user can maintain the second member in the first hand and rotate the tool to sharpen both sides of the blade using the guide surfaces at each end of the abrasive surface, such as illustrated in FIG. 2A. In other cases, only a single guide surface can be provided and, if double sided sharpening is desired, the user can switch hands so that the second (e.g., right) hand holds the second member and the first (e.g., left) hand holds the handle of the tool. Thus, while the various illustrated embodiments generally provide a pair of guide surfaces, this is not necessarily required.

Continuing with the routine of FIG. 13, once the first sharpening operation has been completed, the user can proceed with step 208 where the user grasps the first member in the first hand to present the abrasive member of the second member for a secondary sharpening operation, step 210. As discussed above, the abrasive member of the second member can be a finer grit to provide a honing operation upon the sharpened blade. A reverse guide or a forward guide configuration can be used to orient the blade during the secondary (fine, second) sharpening operation. The reverse or forward guides can be supplied at each end of the second abrasive, or a single guide can be used as desired.

Step 212 shows an optional step that can be carried out to rotationally advance the abrasive media (such as a ceramic rod, etc.) as discussed above in FIG. 8. This step can be carried out prior to either or both of the primary and secondary sharpening operations, as desired. Additionally, in some cases the blade may merely need a small honing operation to dress the cutting edge, so that the primary sharpening steps 204 and 206 can be omitted. Once the sharpening has been completed, the user closes the sharpener at step 214 to return the sharpener to the closed position.

While knives have been contemplated as particularly suitable for sharpening using the sharpeners as embodied herein, substantially any type of cutting tool can be sharpened.

It is to be understood that even though numerous characteristics and advantages of various embodiments of the present disclosure have been set forth in the foregoing description, together with details of the structure and function of various embodiments of the disclosure, this detailed description is illustrative only, and changes may be made in detail, especially in matters of structure and arrangements of parts within the principles of the present disclosure to the full extent indicated by the broad general meaning of the terms in which the appended claims are expressed.

What is claimed is:

1. A sharpener for sharpening a cutting tool having a blade portion with a cutting edge, the sharpener comprising:

a first support member which supports a first abrasive surface, the first support member comprising at least a first guide at a selected end of the first abrasive surface, the first abrasive surface comprising an outer surface of a rotatable abrasive rod;

a second support member which supports a second abrasive surface, the second support member comprising at least a second guide at a selected end of the second abrasive surface;

a hinge assembly which couples the first and second support member to facilitate movement of the second support member relative to the first support member between a closed position and an open position, wherein in the closed position the first guide is in facing relation to the second guide and the first abrasive surface is in facing relation to the second abrasive surface; and a key alignment member affixed to a distal end of the rotatable abrasive rod, the key alignment member comprising a slot adapted to be rotated by insertion of a spine of a blade of the cutting tool therein by a user and rotation of said blade.

2. The sharpener of claim 1, wherein in the closed position the second abrasive surface is nominally parallel to the first abrasive surface.

3. The sharpener of claim 1, wherein in the closed position the second support member is nominally parallel to the first support member.

4. The sharpener of claim 1, wherein the first guide is a forward guide that extends at a first selected angle with respect to the first abrasive surface, wherein the second guide is a reverse guide that extends at a second selected angle with respect to the second abrasive surface.

5. The sharpener of claim 1, wherein the first and second guides are each characterized as forward guides.

6. The sharpener of claim 5, wherein the first and second guides are further characterized as spaced-apart, offset fingers that interlock when the sharpener is transitioned to the closed position.

7. The sharpener of claim 1, wherein the rotatable abrasive rod is characterized as a ceramic rod.

8. The sharpener of claim 1, wherein the second abrasive surface is an outer surface of a leather strop.

9. The sharpener of claim 1, wherein the first and second guides each extend at a guide angle with respect to the associated abrasive surface of from about 20 to 25 degrees.

10. The sharpener of claim 1, wherein the hinge assembly has a limit feature that limits a maximum rotation of the second support member relative to the first support member to nominally 220 degrees so that an intervening angle of nominally 140 degrees exists between the first and second support members to facilitate use, by a user, of a selected one of the first or second support members as a handle while carrying out a sharpening operation upon a cutting tool using a remaining one of the first or second support members.

11. The sharpener of claim 1, wherein the hinge assembly has a limit feature that limits a maximum rotation of the second support member relative to the first support member so that an intervening angle of from about 110 degrees to about 160 degrees exists between the first and second support members to facilitate use, by a user, of a selected one of the first or second support members as a handle while carrying out a sharpening operation upon a cutting tool using a remaining one of the first or second support members.

12. The sharpener of claim 1, wherein the first and second guides are in contacting engagement in the closed position.

13. The sharpener of claim 1, wherein the first and second abrasive surfaces are provided on corresponding first and second abrasive members each having at least a selected one of a round, cylindrical, triangular, frusto-conical, grooved or flat shape.

14. The sharpener of claim 13, wherein each of the first and second abrasive members is formed of at least a selected one of ceramic, metal, leather, stone, sandpaper, an abrasive block, or a diamond coated member.

15. The sharpener of claim 13, further comprising a third abrasive member affixed to an outer surface of the first support member opposite the first abrasive member and a fourth abrasive member affixed to an outer surface of the second support member opposite the second abrasive member.

16. The sharpener of claim 1, wherein the hinge assembly rotates about a hinge axis, wherein the closed position provides the first abrasive surface of the first support member in facing relation and parallel to the second abrasive surface of the second support member so that both the first and second abrasive surfaces intersect a plane normal to the hinge axis, and wherein the open position provides the first abrasive surface of the first support member at a maximum intervening angle determined by a limit feature that prevents further rotation of the second support member with respect to the first support member.

17. A method for sharpening a cutting tool having a blade portion with a cutting edge, the method comprising:

transitioning a foldable sharpener from a closed position to an open position by rotating a second support member relative to a first support member via an intervening hinge assembly that rotates about a hinge axis, the closed position providing a first abrasive surface of the first support member in facing relation and parallel to a second abrasive surface of the second support member so that both the first and second abrasive surfaces intersect a plane normal to the hinge axis, the closed position further providing a first guide surface of the first support member in facing relation to a second guide surface of the second support member, the open position providing the first abrasive surface of the first support member at a maximum intervening angle determined by a limit feature surface of the first support member that prevents further rotation of the second support member with respect to the first support member by way of contact with a shoulder surface of the second support member against the limit surface of the first support member;

performing a primary sharpening operation upon the cutting tool by grasping the second support member in a first hand of a user, grasping the cutting tool in a second hand of the user, and advancing the cutting edge along the first abrasive surface of the first support member; and performing a secondary sharpening operation upon the cutting tool by subsequently grasping the first support member in the first hand, grasping the cutting tool in the second hand, and advancing the cutting edge along the second abrasive surface of the second support member.

18. The method of claim 17, wherein the intervening angle between the first and second support members is from about 110 degrees to about 160 degrees when the limit surface of the first support member contactingly engages the shoulder surface of the second support member.

19. The method of claim 17, further comprising inserting a back portion of a blade of the cutting tool into a slot disposed at an end of a selected one of the first or second support members to rotate a corresponding abrasive member.

20. A sharpener for sharpening a cutting tool having a blade portion with a cutting edge, the sharpener comprising:

a first support member which supports a first abrasive surface, the first support member comprising at least a first guide at a selected end of the first abrasive surface and a limit surface;

a second support member which supports a second abrasive surface, the second support member comprising at least a second guide at a selected end of the second abrasive surface and a shoulder surface configured to contactingly engage the limit surface of the first support member; and a hinge assembly which couples the first and second support member to facilitate movement of the second support member relative to the first support member between a closed position and an open position, wherein the hinge assembly rotates about a hinge axis, wherein the closed position provides the first abrasive surface of the first support member in facing relation and parallel to the second abrasive surface of the second support member so that both the first and second abrasive surfaces intersect a plane normal to the hinge axis, and wherein the open position provides the first abrasive surface of the first support member at a maximum intervening angle determined by contact between the limit surface of the first support member and the shoulder surface of the second support member that prevents further rotation of the second support member with respect to the first support member, the maximum intervening angle being no less than 110 degrees and no more than 160 degrees to facilitate grasping, by a user, of each of the respective first and second support members during sharpening operations utilizing the corresponding second and first abrasive surfaces thereof.

21. The sharpener of claim 20, wherein the first abrasive surface is an outer surface of a rotatable abrasive rod, and wherein the sharpener further comprises a key alignment member affixed to a distal end of the rotatable abrasive rod, the key alignment member comprising a slot adapted to be rotated by insertion of a spine of a blade of the cutting tool therein by a user and rotation of said blade.

22. The sharpener of claim 20, wherein the first guide is a forward guide and the second guide is a reverse guide so that the forward guide and the reverse guide are in facing relation to one another in the closed position and each intersect the plane normal to the hinge axis.

23. The sharpener of claim 20, wherein the first support member has a proximal end adjacent the hinge assembly and an opposing distal end that is distal the hinge assembly, wherein the second support member has a proximal end adjacent the hinge assembly and an opposing distal end that is distal the hinge assembly, wherein the first guide is proximate the proximal end of the first support member, wherein the second guide is proximate the proximal end of the second support member, wherein the first support member further comprises a third guide proximate the distal end of the first support member so that the first abrasive surface is disposed on the first support member between the first and third guides, and wherein the second support member further comprises a fourth guide proximate the distal end of the second support member so that the second abrasive surface is disposed on the second support member between the second and fourth guides.

* * * * *